United States Patent [19]

Purcocks

[11] 4,304,499

[45] Dec. 8, 1981

[54] BINDER SYSTEM, A BINDER SYSTEM SUPPORT DEVICE, AND A BINDER COVER

[76] Inventor: Dale M. Purcocks, P.O. Box 159, Mayfair, Johannesburg, Transvaal Province, South Africa

[21] Appl. No.: 140,930

[22] Filed: Apr. 16, 1980

[30] Foreign Application Priority Data

Apr. 19, 1979 [ZA] South Africa ..... 79/1861

[51] Int. Cl.[3] ..... B42F 13/36

[52] U.S. Cl. ..... 402/15; 402/63

[58] Field of Search ..... 402/63, 9, 13, 14, 15, 402/17

[56] References Cited

U.S. PATENT DOCUMENTS

| | | | |
|---|---|---|---|
| 1,359,606 | 11/1920 | Knoch . | |
| 2,498,901 | 2/1950 | Segal | 402/17 |
| 3,217,372 | 11/1965 | Fellowes | 402/17 |
| 3,285,250 | 11/1966 | Ivory et al. | 402/14 |
| 4,121,892 | 10/1978 | Nes | 402/17 |

FOREIGN PATENT DOCUMENTS

| | | | |
|---|---|---|---|
| 2376756 | 9/1978 | France | 281/15 A |
| 772672 | 5/1978 | South Africa . | |

*Primary Examiner*—Mark Rosenbaum
*Assistant Examiner*—John S. Brown
*Attorney, Agent, or Firm*—Ladas & Parry

[57] ABSTRACT

The invention relates to a support device conventionally used in conjunction with binder systems to support binder strap securing means for securing binder straps in such binder systems, to thereby secure a number of sheets of material together. The support device comprises an elongate member having an elongate channel section body portion and a clamping flange extending from the body portion along the length thereof, whereby an edge portion of a cover sheet or the like can be located and secured between the body portion and the clamping flange. The invention therefore also extends to a binder system including such a support device and to a cover sheet having such a support device secured thereto. By providing two such support devices a number of sheets of material can be bound between two cover sheets secured to the devices.

16 Claims, 4 Drawing Figures

BINDER SYSTEM, A BINDER SYSTEM SUPPORT DEVICE, AND A BINDER COVER

This invention relates to a binder system, a binder system support device, and a binder cover.

According to the invention there is provided a support device for a binder system to support binder strap securing means in a binder system, the support device comprising an elongated member having an elongated channel section body portion, and having an elongated clamping flange extending from the body portion for clamping an edge portion of a cover sheet between it and the body portion for locating the support device on such a cover sheet.

The support device may conveniently, for example, be formed by extrusion.

In one embodiment of the invention the support device may be extruded out of a resiliently flexible material with the clamping flange in its clamping position.

In this embodiment, the clamping flange may be resiliently displaced away from the body portion for insertion of an edge portion of a cover sheet, whereafter the clamping flange may be released to clamp the cover sheet.

The device may thus, for example, be extruded out of a synthetic plastics material, or out of a reinforced synthetic plastics material.

In an alternative embodiment of the invention, the support device may be extruded out of a bendable material to allow the clamping flange to be bent into a clamping position.

The support device may thus, for example, be extruded out of a bendable metal or metal alloy, or out of a synthetic plastics material which is reinforced in the zone of the junction of the clamping flange and body portion with a strip of bendable metal or metal alloy.

The metal or metal alloy may conveniently, for example, be mild steel, aluminium, an aluminium alloy, or the like.

The body portion may conveniently be of lipped channel section.

In an embodiment of the invention, the support device may be extruded with a clamping rib along the body portion or along the clamping flange to deform or penetrate a surface zone of a cover sheet and thus improve the clamping effect of the flange.

If desired, the device may be extruded with at least one pair of complementary clamping rib and groove formations on the body portion and clamping flange to engage positively with a cover sheet during use.

Further in accordance with the invention, a method of forming a support device as described, includes the step of extruding the device out of a suitable material in an elongated strip, and severing the strip at required intervals to provide support devices of required lengths.

Threading apertures may be punched or formed in the support device at desired intervals for receiving one or more binder straps during use.

The threading apertures may conveniently be punched simultaneously with displacement of the clamping flange during clamping of an edge portion of a cover sheet. During such punching of the threading apertures, the materials of the support device will tend to be displaced into the threading apertures thereby improving engagement between the device and a cover sheet.

The invention further extends to a binder system comprising a support device as described, and a pair of binder strap securing means to co-operate with the support device, each strap securing means having a pivot zone to support the securing means pivotably in the channel section body portion to be pivotally displaceable between an unlocked position where it projects from the support device, and a locked position where it lies within the channel section, each strap securing means having locking means for locking it in its locked position, and each securing means having locating means for locating a binder strap thereon.

In an embodiment of the invention the locating means may be provided by an elongated groove extending along the length of the securing means for receiving a binder strap.

The elongated groove may conveniently be defined by opposed side walls which diverge towards the base of the groove.

In this embodiment of the invention, the binder strap may be shaped to be located in the groove by means of a friction fit.

In an embodiment of the invention, the groove may include a plurality of locating formations at spaced intervals along its length, for co-operating with complementary locating formations provided on a binder strap, thereby locating a binder strap in the groove and on the securing means.

The locating formations may conveniently be such that binder strap can be threaded into the groove, but the locating formations will resist unthreading if tension is applied to the strap in the direction of its elongated axis.

The locating formations may therefore, for example, be in the form of a plurality of barbs, steps, shoulders, or curved formations at spaced intervals along the length of the groove, for use with a binder strap having complementary formations at spaced intervals along its length.

In an alternative embodiment of the invention, the locating means may be in the form of a displaceable ratchet member, friction clamp member, or the like which is displaceably mounted on the securing means.

In an embodiment of the invention, the body portion of the support device may be of lipped channel section, and the locking means may be adapted to co-operate with the lipped formations of the body portion to lock the securing means in its locked position.

In this embodiment the pivot zone of each strap securing means may be provided by pivot axes which are shaped to be located in the channel of the lipped channel section body portion.

Each securing means may conveniently be moulded out of a suitable synthetic plastics material.

The binder system may include a pair of binder straps for use in binding sheet material in a binder system.

Each binder strap may conveniently be in a form of an elongated flexible member having mating formations at spaced intervals along its length to co-operate with the locating formations of the locating means.

Each binder strap may conveniently have a threading formation at one end and either a threading formation or an anchor member at its opposed end.

The mating formations may conveniently be in the form of bands, ridges, serrations or the like, which extend about the periphery of the binder strap at axially spaced intervals along its length.

The binder strap may be of any suitable section such as, for example, elliptical, rectangular, round, or the like.

The binder strap may conveniently be formed out of a suitable synthetic plastics material.

The binder system may further include a front cover sheet on which the support device is located, and a rear cover sheet.

In an embodiment of the invention, a support device may be mounted on the rear cover sheet as well, and binder straps having threading formations at both opposed ends, may be employed in the binder system.

In an alternative embodiment of the invention, where only one support device is employed on the front cover sheet, the binder straps may have anchor members at their one end to co-operate with the bottom cover sheet.

The invention further extends to a binder cover having a support device as described, located thereon.

While the binder system of this invention may have application in regard to the binding of sheet material and stationery sheet material, it can have particular application in regard to binder systems for computer sheets and the like.

An embodiment of the invention is now described by way of example with reference to the accompanying drawings.

In the drawings

Figure 1:
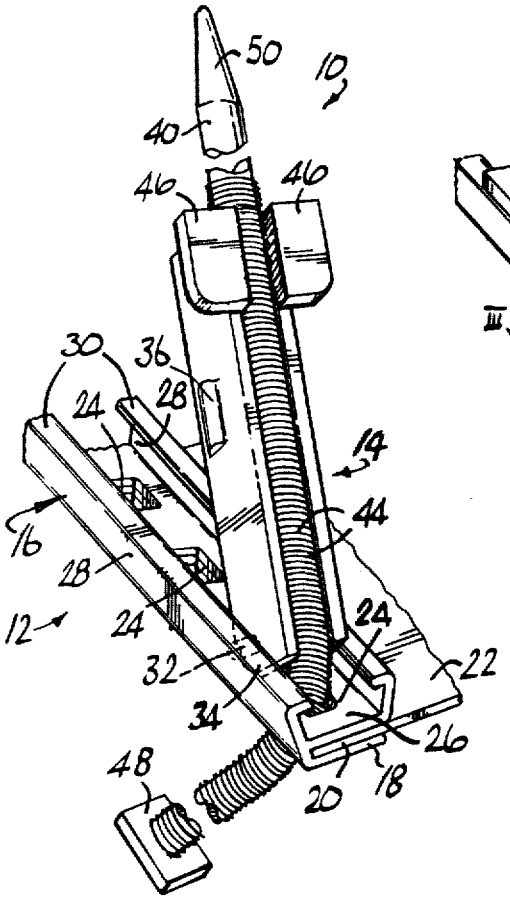
FIG. 1 shows a fragmentary, perspective view of an embodiment of a binder system in accordance with this invention, with the securing means of the binder system in its unlocked position.
Figure 2:
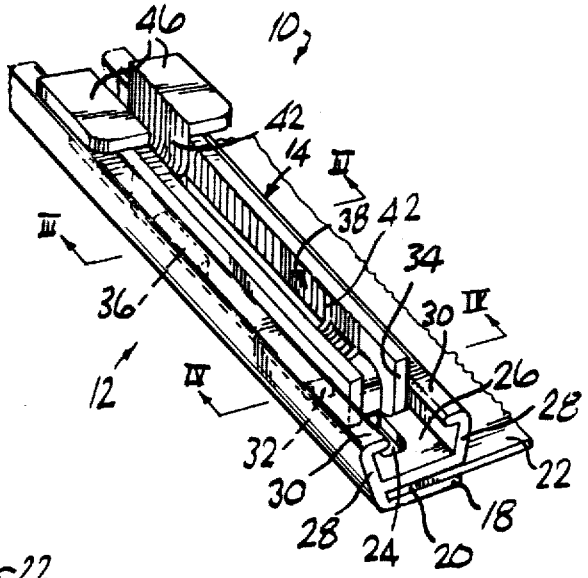
FIG. 2 shows a fragmentary, perspective view of the binder system of FIG. 1, with the binder strap omitted for the sake of clarity, and with the securing means in its locked position.
Figure 3:
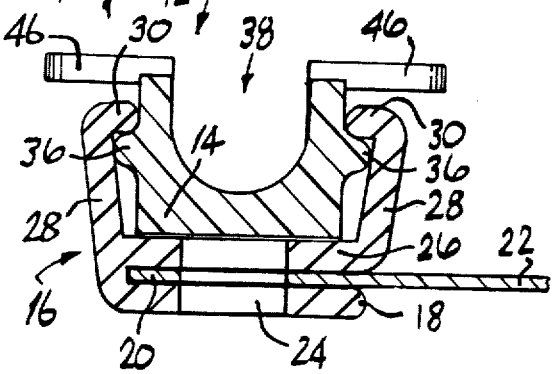
FIG. 3 shows a fragmentary, cross-sectional view of the binder system along line III—III in FIG. 2.

With reference to the drawings, reference numeral 10 refers generally to a binder system for the storage of loose leaf computer sheets.

The binder system comprises a support device 12 for supporting a pair of binder strap securing means 14 (only one being visible) in the binder system 10.

The support device 12 comprises an elongated member extruded out of a suitable aluminium alloy, having an elongated lipped channel section body portion 16, and having an elongated clamping flange 18 extending integrally from the body portion 16.

Figure 4:
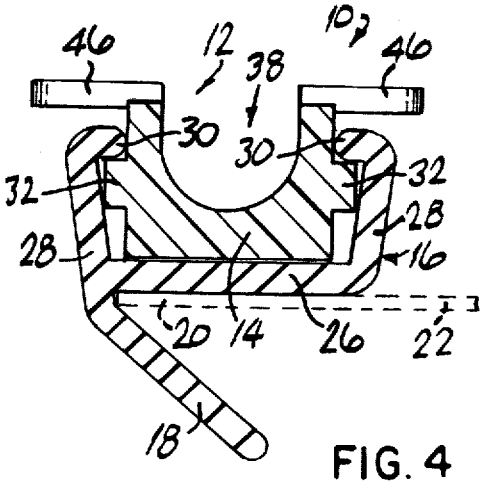
FIG. 4 shows, to an enlarged scale, a sectional fragmentary view of the binder system along line IV—IV of FIG. 2, with the support device in its extruded form as it would be prior to mounting on a cover sheet.

The support device 12 is extruded in elongated lengths in the form shown in FIG. 4 of the drawings with the clamping flange 18 extending at an angle to the body portion 16.

The elongated lengths can then be cut at spaced intervals to provide body portions 16 of appropriate lengths for use.

The body portion is formed out of an aluminium alloy which is bendable to allow the clamping flange to be displaced between its inoperative position as shown in FIG. 4 of the drawings, and a clamping position as shown in the remaining figures of the drawings, to clamp an edge portion 20 of a cover sheet 22 between the clamping flange 18 and the body portion 16 thereby securely locating the support device 12 on the edge portion 20.

The clamping flange 18 may be displaced into its clamping position in a suitable press. While so being displaced, threading apertures 24 may simultaneously be punched at spaced intervals along the length of the support device 12, through the clamping flange 18, the edge portion 20 and the base wall 26 of the body portion 16.

The body portion 16 is defined by the base wall 26, by a pair of opposed side walls 28, and by lip formations 30 which project inwardly from the opposed side walls 28.

Each binder strap securing means 14 has a pair of pivot axles 32 extending outwardly in opposed directions adjacent a pivot end 34 of the securing means 14.

The pivot axles are shaped, as can be seen particularly in FIG. 4 of the drawings, to pivotally locate each securing means 14 in the channel section of the body portion 16, with the pivot axles co-operating with the lip formations 30 to locate the securing means 14 in position.

Each securing means 14 is pivotally displaceable between its unlocked position as shown in FIG. 1 of the drawings, where it extends transversely to the length of the support device 12, and its locked position as shown in the remaining figures of the drawings, where it lies within the lipped channel section of the body portion 16.

Each securing means has locking means in the form of locking shoulders 36 which are shaped to co-operate with the lipped formations 30 to locate the securing means 14 in its locked position.

Each securing means 14 further includes a locating groove 38 which extends the length of the securing means 14 for removably receiving a binder strap 40 to locate the binder strap 40 on the securing means 14 during use.

Each locating groove 38 is provided with a plurality of axially spaced locating grooves 42 for co-operating with complementary locating ridges 44 provided at axially spaced intervals along the length of the binder strap 40 to locate the binder strap 40 in the locating groove 38 against axial displacement along its length.

Each locating groove 38 is defined by a pair of opposed side walls which diverge outwardly towards the base of the groove, thereby allowing the binder strap 40 to be forced into the locating groove 38, but combatting inadvertent dislodgement of the binder strap 40 from the locating groove 38.

Each securing means 14 is provided with a pair of gripping flanges 46 which can be gripped for displacing the securing means 14 into its unlocked position.

The binder system 10 includes a pair of binder straps 40 which are moulded out of synthetic plastics material, for use with the separate securing means 14.

Each binder strap 40 has a shoulder formation 48 at its one end, and a threading formation 50 at its opposed end, and is of resiliently flexible synthetic plastics material.

In use, a support device 12 of a desired length, can be clamped onto an edge portion 20 of the cover sheet 22 as hereinbefore described to firmly locate the support device on the edge portion 20.

Thereafter a pair of securing means 14 can be engaged at opposed ends of the support device 12 by means of the pivot axles 32.

The securing means 14 can then be displaced along the support device 12 until their pivot ends 34 are adjacent threading apertures 24 which are appropriate for the threading apertures provided in the computer sheets to be bound in the binder system 10.

Corresponding threading apertures may be provided in a bottom cover sheet for use with the front cover sheet 22 of the binder system 10.

Thereafter the binder straps 40 may be threaded through the appropriate threading apertures in the bottom cover sheet and drawn through the threading apertures until their shoulder formations 48 engage with the bottom cover sheet.

Thereafter the required computer sheets can be threaded onto the binder straps 40, and the threading formations 50 can be threaded through the appropriate threading apertures 24.

With the securing means 14 in their unlocked position where they project normally to the length of the support device 12, the binder straps 40 can be forced into the locating grooves 38 where they will be clamped against inadvertent withdrawal because of the diverging shape of the side walls defining the locating grooves 38.

In this position the ridges 44 of the binder straps 40 will co-operate with the locating grooves 42 to locate the binder straps 40 in the locating grooves 38 against withdrawal as a result of tension applied to the binder straps 40 along their polar axes.

Thereafter, each securing means may be pivotally displaced about the pivot axles 32 into their locked positions to lock the front cover sheet 22 relatively to the bottom cover sheet, thereby clamping the computer sheets between the front and bottom cover sheets.

Because the pivot axles 32 are spaced from the pivot ends 34 of the securing means 14, during pivotal displacement of each securing means 14 into its locked position, tension will be applied to each binder strap 40 thereby shortening its effective length between the bottom and front cover sheets, and thereby providing a tensioned clamping action to clamp the computer sheets firmly in position between the front and bottom cover sheets.

To release the binder straps 40, the securing means 14 may be displaced into their unlocked positions, the binder straps may be displaced laterally out of the locking grooves 38, and the front cover sheet 22 may then be unthreaded from the binder straps 40.

It is an advantage of the embodiment of the invention as illustrated in the drawings, that the support devices 12 can be readily and effectively formed by cutting off appropriate lengths from an elongated strip of extruded aluminium alloy.

The embodiment as illustrated in the drawings provides the further advantage that since the support device 12 is formed by extrusion out of a suitable aluminium alloy, the edges of the lip formations 30 and the edge of the clamping flange 18 can be smoothly rounded thereby preventing these edges causing damage or injury.

The embodiment of the invention as illustrated in the drawings provides the further advantage that the support device 12 can be effectively and firmly clamped onto an edge portion 20 of the cover sheet 22, and that threading apertures 24 can at the same time be provided at any desired spaced intervals along the length of the support device 12.

It will be appreciated that, if desired, the edge portion 20 may additionally be secured to the base wall 26 and the clamping flange 18 by means of a suitable adhesive.

The embodiment as illustrated in the drawings provides the further advantage that the threading apertures can be provided at any desired intervals to suit a wide range of threading apertures provided in computer sheets of various types, and that the securing means 14 can be displaced along the length of the support device 12 to utilise appropriate threading apertures.

The embodiment as illustrated in the drawings provides the further advantage that the securing means 14 can be locked and unlocked in a simple and effective manner, that the binder straps 40 can be positively located in the locating grooves 38 in a simple and effective manner, and that the binder straps 40 can be tensioned during displacement of the securing means 14 into their locked positions, thereby providing a firm clamping action for clamping computer sheets in position in the binder system 10.

It will be appreciated that, if desired, instead of the binder straps 40 as illustrated in FIG. 1, binder straps may be used having threading formations at both opposed ends. In this embodiment of the invention, it will be appreciated that support devices 12 will be mounted on the edge portions of both the front and bottom cover sheets.

While the binder system 10 may be used as illustrated in the drawings, it will be appreciated that appropriate fold lines may be provided in the front and bottom cover sheets 22 to allow the cover sheets to be folded about the support devices 12 after clamping, to thereby cover the support devices 12 when the binder system is in its stored condition.

I claim:

1. A binder system comprising a support device and a securing means for binder straps of the binder system to co-operate with the support device, the support device comprising an elongate member of a plastically deformable material having an elongate channel section body portion within which a binder strap is securable by the securing means and having an integral clamping flange extending from the body portion along the length thereof for clamping an edge portion of a cover sheet between it and the body portion, by the plastic deformation of the flange portion, for locating the support device on said cover sheet.

2. A binder system as claimed in claim 1, in which each securing means has a pivot zone to support the securing means pivotally in the channel section body portion to be pivotally displaceable between an unlocked position where it projects from the support device and a locked position where it lies within the channel section, each securing means having locking means for locking it in its locked position, and each securing means having locating means for locating a binder strap thereon.

3. A binder system as claimed in claim 2, in which the locating means is provided by an elongated groove extending along the length of the securing means for receiving a binder strap.

4. A binder system as claimed in claim 3, in which a binder strap is locatable in the elongated groove by a friction fit.

5. A binder system as claimed in claim 3, in which the groove includes at least one locating formation along its length for co-operating with complementary formations on a binder strap to thereby locate a binder strap in the groove.

6. A binder system as claimed in claim 2, in which the locating means is such that a binder strap can be threaded into the means but unthreading is resisted if tension is applied to the strap in the direction of its elongated axis.

7. A binder system as claimed in claim 2, in which the support device is of a lipped channel section, and the locking means is adapted to co-operate with the lipped formations of the body portion to lock the securing means in its locked position.

8. A binder system as claimed in claim 7, in which the pivot zone of each strap securing means is provided by pivot axes slidably located in the channel section body portion.

9. A binder system as claimed in claim 2, which includes a pair of binder straps for use in binding sheet material in the binder system.

10. A binder system as claimed in claim 9, in which the binder strap is in the form of an elongate flexible member.

11. A binder system as claimed in claim 2, which includes a cover sheet located within the support device.

12. A support device for a binder system to support a securing means for binder straps of the binder system, the support device comprising an elongate member of plastically deformable material having an elongate channel section body portion within which said binder straps are securable by said securing means when supported by the support device, and having an integral clamping flange extending from the body portion along the length thereof for clamping an edge portion of a cover sheet between the clamping flange and the body portion, by the plastic deformation of the flange portion, to thereby locate the support device on said cover sheet.

13. A support device as claimed in claim 12, which is of a metal material.

14. A support device as claimed in claim 12, in which the body portion is of a lipped channel section.

15. A support device as claimed in claim 12, in which the channel section body portion can support said securing means in a pivotal manner so that it is pivotally displaceable between an unlocked position in which it can project from the support device, and a locked position where it lies within the channel section, each securing means having locking means for locking it in its locked position and each securing means having locating means for locating a binder strap thereon.

16. A support device as claimed in claim 15, in which the body portion of the device is of a lipped channel section, and the locking means of said securing means is adapted to co-operate with the lipped formations of the body portion to lock the securing means in its locked position.

* * * * *